United States Patent [19]

Bertin

[11] 4,262,460

[45] Apr. 21, 1981

[54] MOVABLE AND EXTENSIBLE COVERING FOR LARGE SPANS

[75] Inventor: Elio Bertin, Milan, Italy

[73] Assignee: Flexco S.r.1., Milan, Italy

[21] Appl. No.: 29,275

[22] Filed: Apr. 12, 1979

[30] Foreign Application Priority Data

Apr. 13, 1978 [IT] Italy ..... 22256 A/78
Dec. 11, 1978 [IT] Italy ..... 30703 A/78

[51] Int. Cl.[3] ..... E04B 1/346

[52] U.S. Cl. ..... 52/64; 52/86; 135/DIG. 3

[58] Field of Search ..... 52/86, 67, 64; 135/DIG. 1, DIG. 3

[56] References Cited

U.S. PATENT DOCUMENTS

| | | | |
|---|---|---|---|
| 1,896,433 | 2/1933 | Windeknecht | 52/67 |
| 2,939,467 | 6/1960 | Meyer et al. | 52/2 |
| 3,248,830 | 5/1966 | Maynard | 52/67 |
| 3,415,260 | 12/1968 | Hall | 52/64 X |
| 3,469,587 | 9/1969 | Folkes | 135/1 R |
| 3,526,066 | 9/1970 | Hagar et al. | 52/64 X |
| 3,530,623 | 9/1970 | Burton | 52/64 |
| 4,036,244 | 7/1977 | Huddle | 52/86 X |

*Primary Examiner*—Price C. Faw, Jr.
*Assistant Examiner*—Carl D. Friedman
*Attorney, Agent, or Firm*—Brumbaugh, Graves, Donohue & Raymond

[57] ABSTRACT

A facility cover in the form of an extensible shed has movable arches that support a flexible canvas cover. The arches are modular and are connected in groups by diagonal elements hinged so as to form parallelograms with pantograph movement. The ends of the shed have at least one arch of reduced height so as to form an apse shape. Folding elements are provided on the sides of the shed that cooperate with the hinged parallelogram structure so as to assure that the cover folds outwardly in a bellows fashion as the arches are moved close to each other. As a result, the folding of the cover does not interfer with the movement of the arches.

10 Claims, 9 Drawing Figures

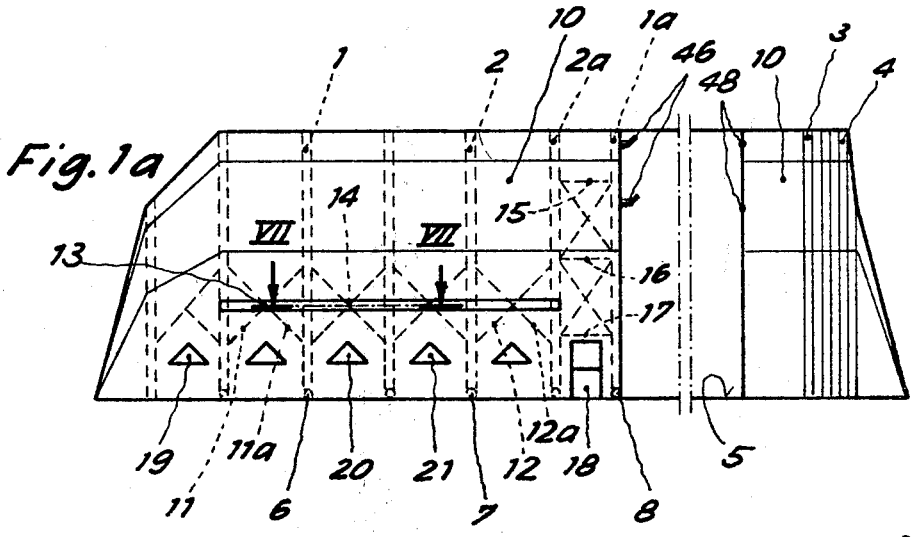
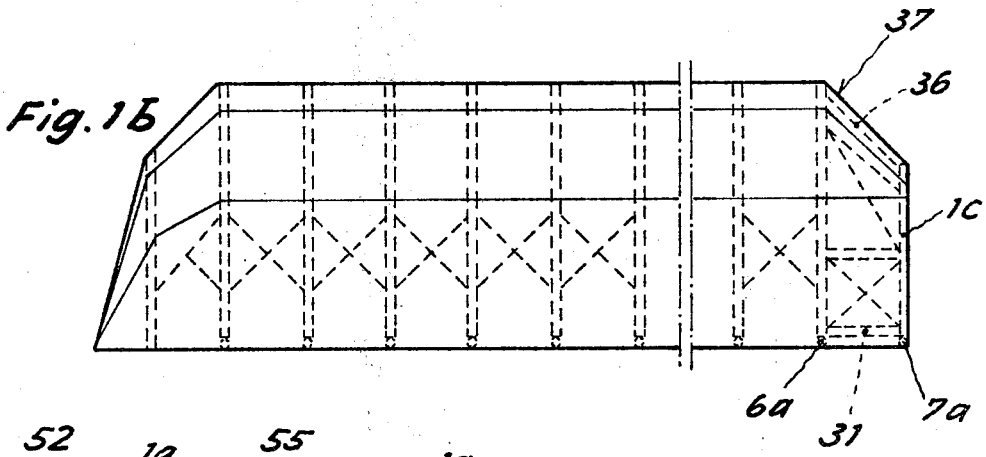
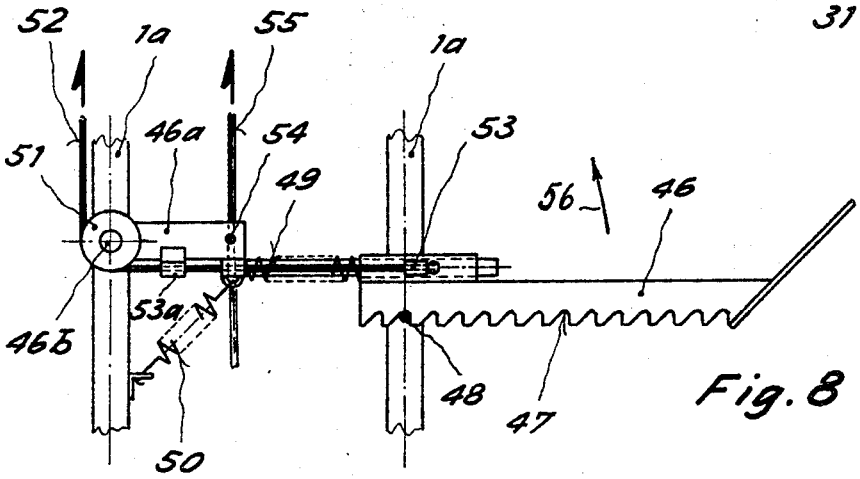
Fig. 8

1d
1c
28
27
30
29
24
25
26
6
22

37
36
1d
1c
32
35
34
33
6a
5
31
7a 6
38
39
40
42
41
5

MOVABLE AND EXTENSIBLE COVERING FOR LARGE SPANS

BACKGROUND OF THE INVENTION

This invention relates to movable and extensible covers for large spans and, more particularly, to extensible sheds for sporting facilities, warehouses and the like.

It is known to provide a cover for sporting facilities or large capacity warehouses in the form of a flexible canvas shed. The canvas for such sheds is supported from several arches to which the canvas is fixed. By mounting the arches on rails they can be moved toward or away from each other in order to extend or retract the shed from over the sports facility or warehouse area. During the retraction operation the canvas folds like a bellows so that the unit can be stored in a neat package to the side of the area covered.

This type of cover or shed, however, is very susceptible to wind damage. Therefore, they are usually made with only small spans. Also, when the cover is divided in the middle, with its sections being retracted in opposite directions, it is difficult and time consuming to attach and detach the two sections with respect to each other.

SUMMARY OF THE INVENTION

It is an object of the present invention to provide a facility cover of the extensible type with large span arches, which cover is movable on parallel horizontal rails. The cover is to be improved in such a way that the arch opening and closing operation is particularly easy. Also, it should be possible to part the arches into two groups that diverge from the central zone of the shed toward its extremities, or to have them extend in a single group from one end. This cover is further to possess great stability, even in the worst weather conditions, and yet is to allow the nearly complete uncovering of the covered area, thus giving complete accessibility to it from every side.

Another objective of the invention is to create a divided extensible cover that is movable on rails and is fitted with improved means for obtaining automatic coupling of the central arches, which meet face to face during closing, as well as an improved movement of the central arches as they approach each other in order to perfect the closing.

It is still another object of the invention to form a sliding arch shed constructed in such a way that it is possible to have doors in the shed which are always accessible, even when the shed is closed, as well as transparent windows or similar openings so as to provide complete indoor illumination.

In an illustrative embodiment of the invention these objects are achieved by forming the cover as an extensible bellows shed comprised of several large self-sustaining arches. These arches are made from modular elements that support a flexible covering canvas, slide on horizontal rails and are connected together by pairs of diagonal elements that form hinged parallelograms with pantograph movement. As a result, the arches have greater stability.

For the closing of each of the terminal ends of the shed, provision is made for at least one vertical arch of reduced height in comparison with the others at each terminal end. These lower arches are rigidly secured to the ground by means of bars, connecting rods or similar members. With the lower arches the structure is shaped like an apse and supports the covering canvas between the last full arch of the shed and the ground. This canvas is raisable by means of a winch or similar device in order to uncover the apse of the shed so as to allow for indoor ventilation when the shed is closed. The winch may be operated manually or through a motor reducer.

In one embodiment the arches are linked by the diagonal elements into a single group that extends from one end of the covered area. However, in another embodiment the arches can be parted into two groups that slide from a central zone and stop at the two ends of the covered area. In order to cause the arches to move together and apart easily, they are acted upon by devices, preferably by motor reducers, attached to the arches at one end of the shed, in the case where all of the arches are in a single group on one side, or attached to the arches of the central zone of the shed, in the case of two separate groups of arches positioned at opposite ends of the covered area.

Provisions are made with the design involving two groups of arches for coupling devices that connect the first two central arches of each group and keep them vertical and separate during the opening and closing movement. The coupling means are designed as a barring gear or saw tooth means applied on the periphery of the center arches that meet face-to-face, preferably in a central position, in order that they may couple at fixed points of the opposite arch to lock them together. At least one of the coupling means may be provided with a rope or other flexible connection attached to an electrical mechanism or similar device capable of pulling the arches together from a position near their base until their front edges meet, and locking them in such a position via the barring gear for a total closing of the covering. In order to release the center arches and to be able to open the covering, the barring gears are released simultaneously by means of another rope or similar device connected with an electrical mechanism or the like, so as to raise the barring gear from the connection point on the opposite movable arch.

The wheels on the arches which permit their movement are equipped with substantially T-shaped members that slide in C-shaped slides. The slides are placed parallel to the running rails and are suitable to ensure stability for the whole structure against wind thrust on the sides of the shed.

Arrangements are also made for folding means associated with each hinged parallelogram. These folding means act horizontally on the canvas so as to hold it toward the outside in bellows fashion during the closing together of the arches. Rigid horizontal slides connected by flexible elements which favor the folding on the outside, are part of the folding means. Because of the outward bellows folding the parallelogram linkages are not impeded during the closing together of the arches.

As a result of the design of the present invention, greater stability against adverse weather conditions and a stiffer structure are obtainable as well as simplier and easier operations for the opening and closing of the arches and the opening of the canvas at the shed apses.

BRIEF DESCRIPTION OF THE DRAWINGS

The invention will now be described in more detail according to preferred, but not exclusive, forms of practical construction, and with reference to the attached drawings, in which:

FIGS. 1*a* and 1*b* show schematic side views of extensible sheds built according to the invention with a center division and movement in both directions, and with a single unit and movement in one direction only, respectively;

FIG. 8 shows in side view a coupling device or barring gear for the automatic coupling of the arches of FIG. 1*a* in the closing and opening operation.

DESCRIPTION OF ILLUSTRATIVE EMBODIMENTS

Figure 2:
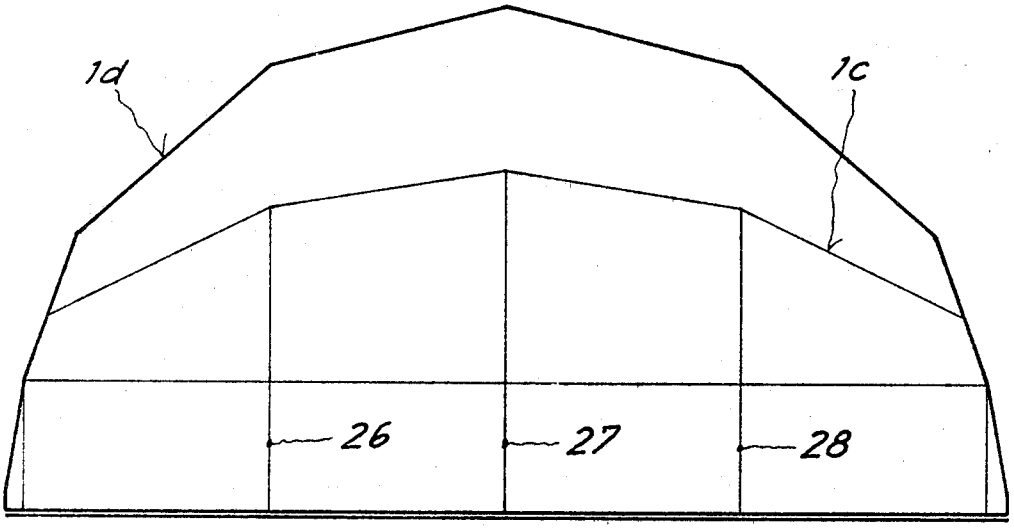
FIG. 2 shows a front schematic view of one end of the shed of FIG. 1 with the canvas partially raised.
Figure 3:
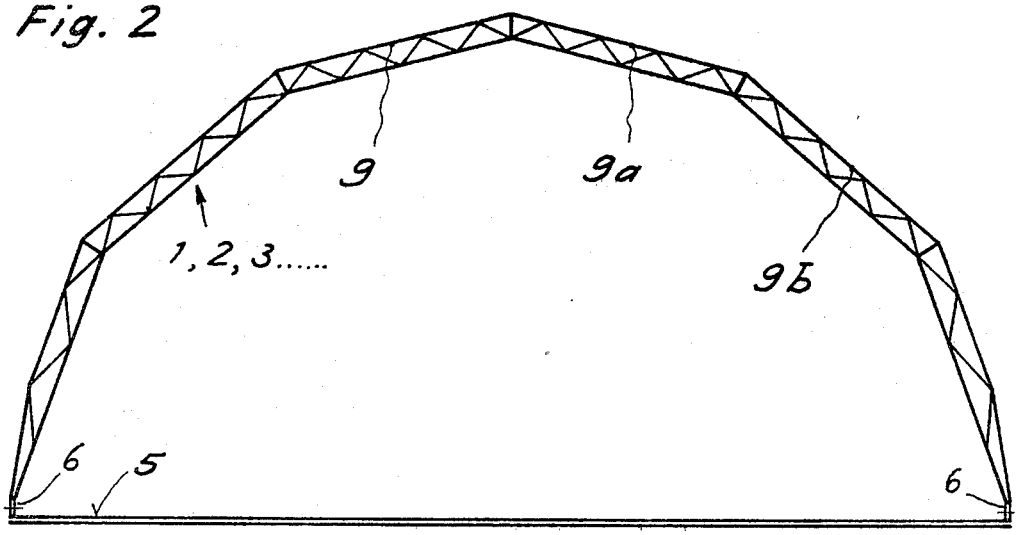
FIG. 3 shows a cross section of the shed of FIG. 1, in particular a sustaining arch according to the invention.

Referring to FIGS. 1 to 3, the facility cover is shown as an extensible shed having a set of arches 1, 2, 3, 4, etc. These arches have a large span and slide on horizontal rails 5 by means of wheels 6, 7, 8, etc., which are each separately associated with a foot or base of each arch. Each arch, as shown in FIG. 3, is made of rectilinear modular arches 9, 9*a,* 9*b* and so on, of the lattice type or similar construction. They are rigidly fixed together so as to form a continuous plane curved arch structure. The arches are movable and can be grouped in two separate groups, one at each end of the shed, or they can be in a single group at one end of the shed only. In the first case shown in FIG. 1*a* the opening of the shed starts from the center with the arches moving in both directions, while in the second case the opening of the shed starts at one end and continues in a single direction (FIG. 1*b*). The arches of each group support a covering canvas 10 of high strength flexible material, which is secured to each arch according to known methods.

The arches are connected together and kept in vertical planes by pairs of diagonal rod-shaped elements 11, 11*a,* 12, 12*a,* and so on (FIG. 1), which pairs of diagonal rods are hinged together at their middles 13, 14, etc. Also, one of the ends of each of these rods is hinged on the arch and the other slides within slots made in the structure of the arch itself. As a result, each pair of rods can rotate around the hinges 13, 14, etc. with scissors movement, i.e. like a hinged parallelogram with pantograph motion. As a result the rods keep the arches parallel and in the vertical position during an opening of the shed, i.e. a closing together of the arches, or a closing of the shed.

In the zone of separation of the arches of FIG. 1*a* which arches are in two groups, the first two arches 1*a* and 2*a* are stably connected together by crossing and diagonal stiffening rods 15, 16, 17. In this way each pair of nearby arches 1*a,* 2*a,* forms a carriage which can run on the rails while keeping a rigid separation so that the pertaining zone of the canvas will be well stretched even during the opening and closing operations. This construction yields great stability to the whole structure, allows for an easy running of the arches on the rails and allows for the opening between the arches of a door 18 on each side. Such doors serve as entrances to the covered facility when the shed is closed and are unaffected by the opening of the shed because the stiffening rods 15–17 keep arches 1*a,* 2*a* in position. On the two longitudinal sides of the shed, triangular windows 19, 20, 21, etc. exist, which windows are made of flexible and transparent material so as to provide illumination and, when they are opened, ventilation.

Figure 4:
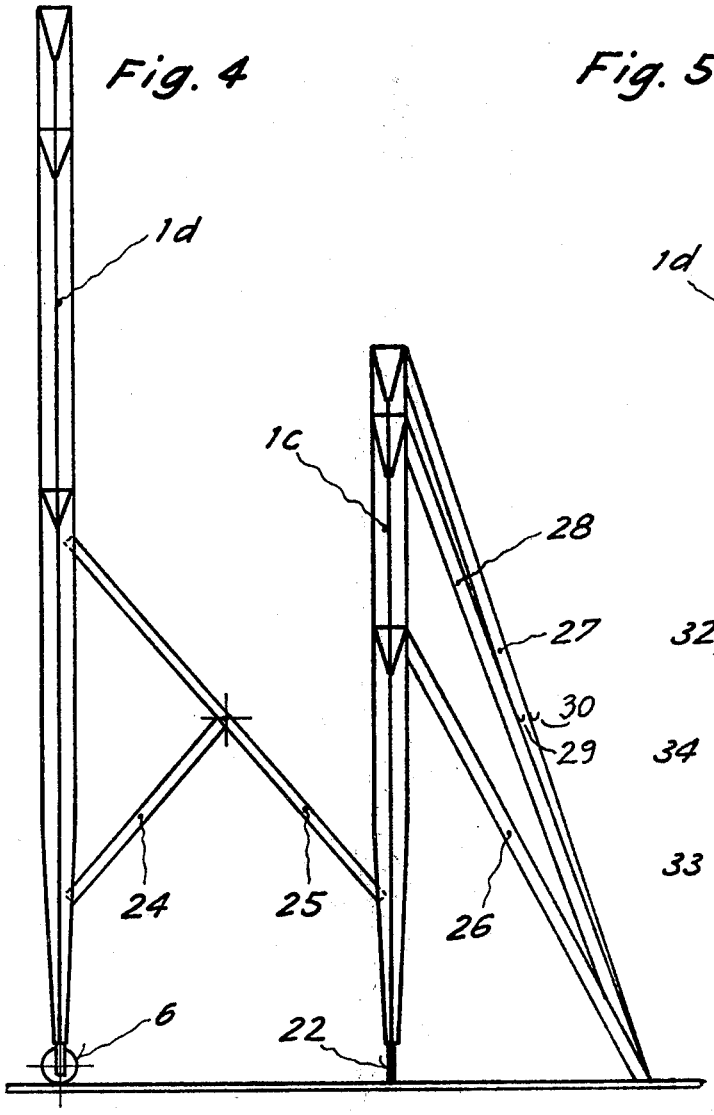
FIG. 4 shows, in side view, the sustaining structure of a fixed terminal end of the shed of FIG. 1*a;*

Each terminal apse (FIGS. 2, 4, 5) comprises an arch 1*c* lower in height than the first sliding arch 1*d.* Arch 1*c* is secured vertically to the ground at point 22 when it is at the fixed end of the shed (FIG. 4). The lower arch is connected on one side to the nearby sliding arch by means of hinged members 24, 25 forming a parallelogram, while on the opposite side it is secured to slanting rods 26, 27, 28, fixed to the ground. The flexible canvas 10 is secured to the lower arch, supported by the tie rods 26, 27, 28 and reaches the ground where it is held by known means.

The lower part of the canvas can be raised from the ground a distance sufficient to ventilate the inside of the shed, as is shown in FIG. 2. When raised, the canvas is sustained there by suitable eyes 29, 30 (FIG. 4). To such end provision is made for winches placed at the sides of the apse, and driven by a motor reducer (not shown), which can raise the canvas at full span and at the chosen height, while allowing the canvas to slide along rods 26, 27, 28.

Figure 5:
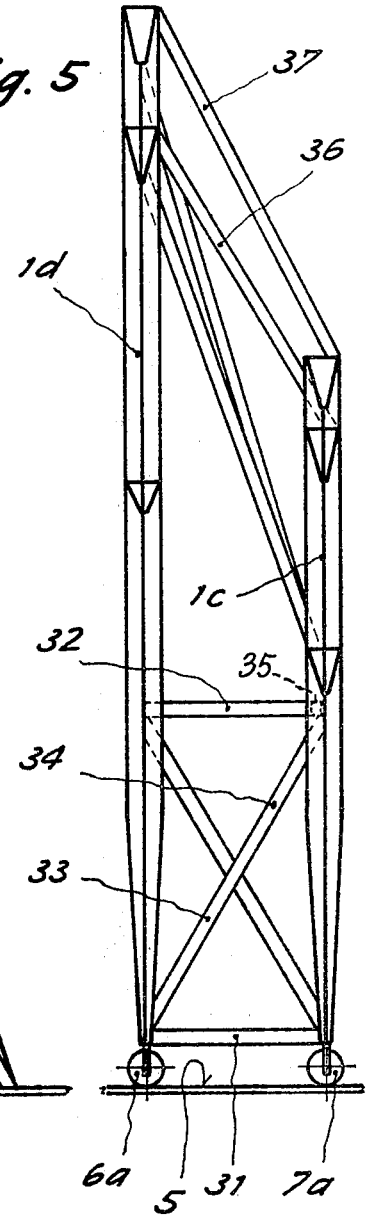
FIG. 5 shows, as an alternative to the apse of FIG. 4, a side view of the movable apse of FIG. 1*b;*

In the case of a shed that opens in a single direction (FIG. 1*b*), the apse can be built to be movable and without the slanting rods. Such an apse is built with the arch 1*d* and the lower arch 1*c* on wheels constrained to the rails 5 (FIG. 5). Connecting these arches are rigid cross beams 31, 32 and diagonal rods 33, 34 with, at the height of the cross rods 33, a transverse beam 35 secured to the opposite sides of the lower arch. Beam 35 is placed along a cord of the arch. The whole unit, which is also shown to the right in FIG. 1*b* for the shed that opens in one direction, constitutes a movable carriage analogous to that described previously with respect to FIG. 1*a,* for the shed that opens in both directions. With the arrangement of FIG. 5 the canvas drops from the arch 1*d,* is fastened to the slanting rods 36, 37 (which connect the arches 1*d,* 1*c* on top), passes over the lower arch 1*c* in contact with the transverse beam 35 and drops to the ground. Raising the canvas up to the level of the transverse beam 35 leaves the whole span free from obstacles.

Figure 6:
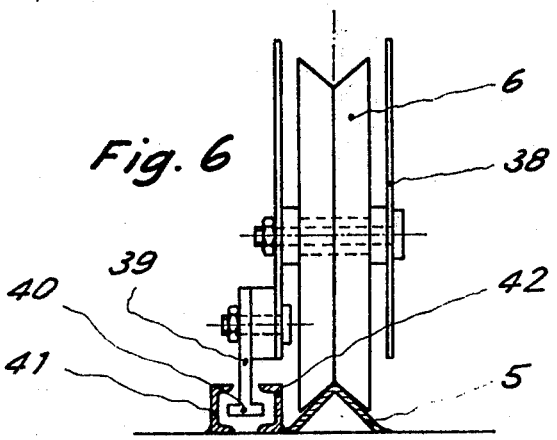
FIG. 6 shows in cross section a supporting wheel at the side of a movable arch equipped with devices for securing the shed against side thrusts.

The stability of the whole structure as regards winds blowing against its sides, is achieved by suitable securing means for each wheel supporting an arch. As it appears in FIG. 6, the supporting wheel 6 has an angular groove and runs on a plain V-shaped slide rail 5 with a cross section forming a slightly smaller angle than that of the wheel, so as to allow for some possibility of a small sideways oscillation to compensate for elastic adjustment. The support 38 of the wheel is solidly connected with an inverted T-plate 39, which with its short side 40 slides within a guide comprised of two C-shaped irons. The irons are arranged opposite and parallel to each other and are placed on the outer sides of the rails 5. As a result any raising of the wheel from the rails is prevented.

Figure 7:
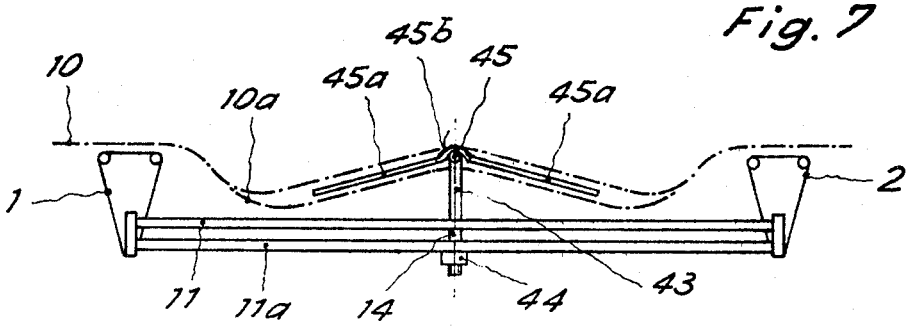
FIG. 7 shows schematically and along a section VII—VII of FIG. 1*a,* a folding element able to push out the side of the canvas during the closing of the arches.

To obtain a regular formation of the "bellows" on the outside of the shed in cooperation with the hinged parallelograms, a horizontal rod 43 (FIG. 7) is provided. This rod 43 is fixed to a pivot connection 44 at pivot points 13, 14, etc. of each hinged parallelogram and has its free extremity coupled to a vertical spacing element 45. Within a channel of the canvas labeled with 10*a* in FIG. 7, a canvas pushing element is housed, which element includes two horizontal rigid rods 45*a* connected together by a flexible connection 45*b* made of rubber or similar material. Vertical rod 45 makes contact with the flexible coupling 45*b*. At the beginning of the canvas folding operation, the vertical spacer 45 pushes the central part 45*b* toward the outside and allows the closing toward the inside of the two rods 45*a* until a bellows fold on the outside is formed in the canvas. Since vertical rods 45 extend only along the sides of the arches at the height of the parallelogram, as the arches draw nearer to each other the canvas covering the shed upper region or vault, forms bellows between the arches toward the inside of the shed. The canvas adjacent rods 45 and covering the sides of the shed for the full height of the hinged parallelograms forms, on the contrary, bellows folded toward the outside of the shed. Therefore, the canvas at the sides of the shed is of no impediment to the closing movement of the hinged parallelograms.

The carriages formed by the pairs of arches 1*a*, 2*a* of FIG. 1*a* are moved by means of motor reducers (not shown) applied at the supporting wheels. For the locking of the arches in the closing operation, provision is made for barring gears 46, 48. These gears are placed preferably midway on the upper part of the arches 1*a* of each group so that at first the arches grapple each other and then the complete closing is performed by a manual operation at ground level. Such barring gears (FIG. 8) include a sawtooth 47 formed in plate 46, which plate is supported by a rectilinear arm 46*a* via a rigid member 46*c*. At one end arm 46*a* is hinged at 46*b* on the arch 1*a* of one of the two carriages, e.g. the carriage to the left in FIG. 1*a*, and is kept substantially horizontal. On the arch 1*a* of the other carriage, i.e. the carriage to the right, a joining pivot 48 is fixed so as to engage with the teeth 47 and provide positive locking. A tension spring 50 placed diagonally between the left arch 1*a* and the free end of arm 46*a*, helps to engage the joining pivot 48 with the teeth 47 by urging plate 46 in a clockwise direction. Thus stable locking is assured when the arches of the two groups have been driven together by their motor reducers.

The toothed plate 46, besides being hinged at 46*b*, can slide axially along member 46*c* against a spring 49, in moving closer to the pivot 46*b*. Plate 46 is connected with a rope, a metallic wire or similar traction device 52 positioned in a slot 53 of plate 46. The rope extends through the eye 53*a* of plate 46*a* and then around a pulley 51 that rotates on pivot 46*b*. From the pulley the rope goes to a lever or similar mechanism operated manually or through any other means, from a position close to the foot or base of the arch. By pulling the rope 52 the plate 46 is compelled to displace axially, thus compressing the spring 49 which, when the tension is removed from the rope, will bring it back to its initial position. This moves the pin 48 to a further position on the teeth 47.

The other barring gears distributed along the two facing arches need not have a rope or traction device and they can engage automatically in the fixed pins 48 as the opposite arches are brought progressively closer together. In such a way the arches of the opposite carriages are brought close together in a step-by-step process until their edges meet. In particular the driving motors with reducing gears for the wheels 6 move the arches until the teeth 47 of one arch fasten on the pin 48 of the other. Then the final closure is achieved by applying tension to rope 52 from a ground position.

The levers 46*a* that support the plates 46 for axial movement, or just oscillating movement, are connected at an arbitrary point, for instance at point 54, with a second rope 55. Rope 55 connects all the barring gears and can be operated from ground level, as is rope 52. when tension is applied to rope 55 by pulling on it, the barring gears are subjected to a displacement force in the direction of arrow 56 which is sufficient to overcome the spring 50. As a result, action to disengage simultaneously all of the plates 46 from the fixed pins 48 of the opposite arch, is produced and the two carriages are freed from the coupling and locking of the barring gears.

In practice the improvements specified above allow easier opening and closing operations for the groups of arches, the possibility of ventilation of the shed when required, and a great lateral stability of the whole structure, even in the most adverse weather conditions. Obviously, structurally and functionally equivalent variations can in practice be substituted for the devices described, without departing from the scope of the invention as defined by the appended claims.

I claim:

1. A shed of the extensible type, having arches movable on rails and supporting a flexible cover, characterized in that:

said arches are self-sustaining and are made up of modular elements, adjacent ones of said arches are connected together in a single group by means of diagonal elements hinged so as to form parallelograms with pantograph movement that keep the arches spaced and vertical during the opening and closing of the shed, said shed is opened with movement of the arches in a single direction and closed with movement in the opposite direction, one end of the shed is fixed to the ground and the other end is movable on rails as a carriage;

the ends of the extensible shed each have at least one arch of lower height so as to form an apse shape that closes each of said ends, said lower arch is connected to the adjacent sliding arch by means of cross beams and by at least one transversal element placed along a chord of the lower arch substantially at the height of said hinged parallelograms, slanted rods are provided between the adjacent arch and the lower arch suitable for stiffening the arch complex and providing support for and fastening of the canvas at the end of the shed, said canvas is stretched between said lower arch and the ground; and folding means are fixed to each hinged parallelogram for acting horizontally on the canvas adjacent said parallelograms to fold the canvas in bellows fashion toward the outer side of the shed during the opening of the shed when the arches are approaching each other.

2. A shed of the extensible type, having arches movable on rails and supporting a flexible cover, characterized in that:

said arches are self-sustaining and are made up of modular elements, adjacent ones of said arches are connected together in at least one group by means of diagonal elements hinged so as to form parallelograms with pantograph movement that keep the arches spaced and vertical during the opening and closing of the shed, at least one end of the group of arches is movable and the other end is secured to the ground;

the ends of the extensible shed each have at least one arch of lower height so as to form an apse shape that closes each of said ends, said lower arch supports the covering canvas which is stretched between it and the ground;

folding means are fixed to each hinged parallelogram for acting horizontally on the canvas adjacent said parallelograms to fold the canvas in bellows fashion toward the outer side of the shed during the opening of the shed when the arches are approaching each other;

wheels are mounted in supports for each of said arches so as to make them movable; and stabilizer means are provided to stabilize the shed against lateral wind thrusts, said stabilizer means comprising T-shaped guiding means associated with said supports for the wheels of the arch and C-shaped slides placed parallel to and on the outer side of the rails, a head section of said guiding means sliding within said C-shaped slides.

3. A shed of the extensible type, having arches movable on rails and supporting a flexible cover, characterized in that:

said arches are self-sustaining and are made up of modular elements, adjacent ones of said arches are connected together in at least one group by means of diagonal elements hinged so as to form parallelograms with pantograph movement that keep the arches spaced and vertical during the opening and closing of the shed, at least one end of the group of arches is movable and the other end is secured to the ground;

the ends of the extensible shed each have at least one arch of lower height so as to form an apse shape that closes each of said ends, such lower arch supports the covering canvas which is stretched between it and the ground;

folding means are fixed to each hinged parallelogram for acting horizontally on the canvas adjacent said parallograms to fold the canvas in bellows fashion toward the outer side of the shed during the opening of the shed when the arches are approaching each other, said folding means is in the form of rigid elements associated with the hinged parallelograms, said rigid elements comprising horizontal pivot rods positioned at the pivot points of the parallelograms, said horizontal rods acting against rigid vertical rods that contact and press against horizontal flap bars which are fixed to the canvas and are flexibly joined along the vertical plane of the fold.

4. A shed of the extensible type, having arches movable on rails and supporting a flexible cover, characterized in that:

said arches are self-sustaining and are made up of modular elements, adjacent ones of said arches are connected together in two groups by means of diagonal elements hinged so as to form parallelograms with pantograph movement that keep the arches spaced and vertical during the opening and closing of the shed, one end of each group of arches is fixed to the ground and acts as the end of said shed, while the other ends of each group are in the form of two central arches movable toward and away from each other to open and close the shed;

the ends of the extensible shed each have at least one arch of lower height so as to form an apse shape that closes each of said ends, said lower arch supports the covering canvas which is stretched between it and the ground;

folding means are fixed to each hinged parallelogram for acting horizontally on the canvas adjacent said parallelograms to fold the canvas in bellows fashion toward the outer side of the shed during the opening of the shed when the arches are approaching each other; and coupling means are provided for connecting and locking together the two central movable arches of each group, said coupling means includes at least one barring type gear located on the opposite central arches of the groups to be coupled, said barring gear comprising oscillating parts carrying hook-like teeth on one central arch that engage with fixed parts of the opposite arch, at least one of said oscillating parts is displaceable axially by means of a rope extending close to the base of the arch in such a way that the opposite arch is pulled until the facing edges of the central arches meet.

5. A shed according to claim 4 characterized in that said barring gear teeth are releasable from engagement with the opposite central arch by applying tension to a second rope extending to the base of the arch, said second rope raising the teeth off of said fixed part.

6. A shed according to claim 5 wherein the coupling means comprises a plurality of barring gears distributed midway on the upper part of the central arches, all of said gears being releasable simultaneously by said second rope.

7. A shed according to claim 4 characterized in that the pair of arches at the movable ends of the groups of arches are connected together and stiffened to form a movable carriage.

8. A shed according to claims 1, 2, 3, or 4 or 5 characterized in that a door is provided in said movable carriage.

9. A shed according to claim 1 characterized in that flexible windows are provided in the sides of said shed.

10. A shed according to claim 1, 2, 3, or 4 wherein the canvas is raised from the ground at the ends of the shed by winches.

* * * * *

UNITED STATES PATENT AND TRADEMARK OFFICE

CERTIFICATE OF CORRECTION

PATENT NO. : 4,262,460

DATED : April 21, 1981

INVENTOR(S) : Elio Bertin

It is certified that error appears in the above—identified patent and that said Letters Patent is hereby corrected as shown below:

First page, last line of ABSTRACT, "interfer" should read --interfere--;
Column 2, line 60, "simplier" should read --simpler--;
Column 6, line 9, "when" should read --When--;
Column 8, line 49, "5" should read --6--.

Signed and Sealed this

*Fifteenth* Day of *September 1981*

[SEAL]

*Attest:*

GERALD J. MOSSINGHOFF

*Attesting Officer*

*Commissioner of Patents and Trademarks*